US005154807A

United States Patent [19]

Harvey

[11] Patent Number: 5,154,807

[45] Date of Patent: * Oct. 13, 1992

[54] METHOD OF AND ELECTROLYTIC-CATALYTIC CELL FOR IMPROVING THE COMPLETION OF COMBUSTION OF OXYGENATED HYDROCARBON FUELS BY CHEMICALLY MODIFYING THE STRUCTURE THEREOF INCLUDING THROUGH DEVELOPING HYDROXYL IONS THEREIN

[75] Inventor: Draper M. Harvey, Hingham, Mass.

[73] Assignee: Academy of Applied Science, Concord, N.H.

[ * ] Notice: The portion of the term of this patent subsequent to Nov. 6, 2007 has been disclaimed.

[21] Appl. No.: 814,764

[22] Filed: Dec. 30, 1991

Related U.S. Application Data

[60] Division of Ser. No. 304,187, Jan. 30, 1989, Pat. No. 4,967,396, and a continuation-in-part of Ser. No. 557,944, Jul. 26, 1990.

[51] Int. Cl.[5] ..... C25F 5/00

[52] U.S. Cl. ..... 204/131; 204/222; 204/242; 204/272; 204/280; 204/292

[58] Field of Search ..... 204/101, 130, 131, 242, 204/272, 280, 292, 222, 212, 157.15, 157.52, 157.44; 429/17, 27, 68, 94; 123/538

[56] References Cited

U.S. PATENT DOCUMENTS

| | | | |
|---|---|---|---|
| 4,373,494 | 2/1983 | McMahon | 123/538 |
| 4,563,286 | 1/1986 | Johnson et al. | 210/721 |
| 4,865,003 | 9/1989 | Scharnweber et al. | 239/708 |

*Primary Examiner*—John Niebling
*Assistant Examiner*—Kathryn Gorgos
*Attorney, Agent, or Firm*—Rines and Rines

[57] ABSTRACT

A method and electrolytic catalytic cell that chemically modifies the structure of hydrocarbon fuels in which the cell is immersed, by electrochemical series potential, electrolytic cell and catalytic action of preferably a noble metal cathode and zinc anodic elements movably continually contacting and circulating the fuel, giving rise to evenness in ignition and completion of combustion with elimination of noxious by-products largely by combination with the hydroxyl ions formed by the catalytic action. Preferred helical-cathode and anode cell structures and other types of hydroxyl ion generators are described for scavenging also in post-combustion exhausts including industrial effluents.

20 Claims, 3 Drawing Sheets

METHOD OF AND ELECTROLYTIC-CATALYTIC CELL FOR IMPROVING THE COMPLETION OF COMBUSTION OF OXYGENATED HYDROCARBON FUELS BY CHEMICALLY MODIFYING THE STRUCTURE THEREOF INCLUDING THROUGH DEVELOPING HYDROXYL IONS THEREIN

This application is a division of parent U.S. patent application Ser. No. 304,187, filed Jan. 30, 1989, and allowed Apr. 25, 1990, now U.S. Pat. No. 4,967,396, issued Nov. 6, 1990, and continuation-in-part of copending U.S. patent application Ser. No. 557,944 filed Jul. 26, 1990.

BACKGROUND

The present invention, as described, relates to methods of and catalytic cells for improving the totality and progression of completion of combustion of oxygenated hydrocarbon fuels, being more particularly directed to pre-combustion catalytic treatment of and chemical hydrocarbon change in the fuel, including the development of hydroxyl ions, that, upon combustion, causes the fuel to propagate ignition evenly through the entire combustion process within any internal combustion mechanism, substantially eliminating noxious by-products. More generically, the invention relates to elimination of such undesired by-products of hydrocarbon combustion and the like through the development of hydroxyl ions that during and following combustion have been found to scavenge or remove such by-products—such being applicable to other hydrocarbon burning or consumption systems than internal combustion engines, as well.

The invention is designed more specifically, in preferred, though not exclusive, application, for the principal purpose of providing for improved combustion characteristics of gasoline as an internal engine fuel with benefits that include (a) improved startability under adverse ambient conditions; (b) decrease in the formation of noxious and contaminating elements as contained normally within the exhausted products of combustion as these enter the atmosphere, including carbon monoxide, hydrocarbon particulates, nitrogen oxide and other exhausted products, some of which are carcinogenic when aspirated or when such products come in contact with skin surfaces of humans; (c) to provide for an extended service life of catalytic converters as used on automotive vehicles; and (d) to result in a decreased requirement of gasoline as an engine fuel as a product of more complete combustion with extrapolated development of useful energy in excess of the normal combustion characteristics of this engine fuel, a supporting refernce to which is evident by an elimination or reduction of combustion by-products, including carbon monoxide, HC particulates and nitrogen oxide.

The application of this invention, either as an original equipment accessory or as a retro-fit product, is with positive benefit to environmental conditions at any gridlock locus of vehicle emissions contamination since noxious products of emissions are transported by air currents for great distances. Such emission products, entrained within the atmosphere, combine with moisture within the atmosphere to form super-acid precipitation, subsequently to the displacement of carbon dioxide in natural precipitation. The adverse influence of such super-acid precipitation on terrestrial and aquatic life forms and the potability of ground water resources if recognized as an ongoing and expanding environmental hazard. Since noxious emissions from vehicles represent in excess of forty percent (40%) of atmospheric pollutants, the application of this method of emission control or elimination is a technology with merit in the suppression of environmental hazards, including acid rain and ozone contamination.

The art is replete with techniques for catalytically and otherwise aiding the combustion of oxygenated hydrocarbon fuels. Among such is the application of minute trace particles of platinum in hydrocarbon fuels preliminary to combustion, hopefully to improve completeness of the combustion, or to introduce a bubble of air containing platinum traces for mixture with the fuel within the entering air stream. The lack of efficacy of such methods is demonstrated by the mandated application of two and three stage catalytic converter systems which by design are intended to induce combustion of emission by-ptoructs within an after-burner device and before emission products enter the atmosphere.

Underlying the invention of said parent application is the discovery that immersion of the catalytic element in the fuel within the fuel tank provides for a continued surface contact of an anode of zinc metal and a cathode of the platinum family such as of partly platinum and partly rhodium to provide for a catalytic response in the fuel by means of electrolysis. The pre-combustion catalytic response effected by the anodic and cathodic electromotive action in the electrolytic fuel, stemming from the inherent generation of electrochemical series fractional or few volt potentials developed by the contacting different metals (see, for example, Handbook of Chemistry and Physics, "Electrochemical Series" by Peter Vanjack, 67th Ed. 1986-7, pp D-151, on) as later discussed, is of such a nature as to electrochemically modify or alter the structure of the hydrocarbon fuel with its entrapped oxygen and water, generating hydroxyl ions and hydrogen oxides within the fuel, the former having been found effectively to scavenge or substantially eliminate the above-described and other undersired combustion by-products. The minimal requirement of the ionization of the noble metals as required for effective catalization of the hydrocarbon fuel is affirmed by the extended efficacious use of the invention as a catalyst within the fuel supply of a vehicle for a period of three or more years of normal vehicle operation.

With the use of this invention and subsequently to the catalytic response of the fuel, a phenomenon which is prompt and sustained, it has been found that the modified fuel ignites promptly with even propagation of the combustion flame front during the entire combustion process. When the altered fuel is consumed it has been found that hydrogen oxides within the fuel mixture act beneficially and in the manner of tetraethyl lead (TEL) and other prior fuel additives to reduce octane requirements and at the same time that the hazards associated with the use of TEL are eliminated. The hydrogen oxides, pre-developed in the fuel by catalytic action, serve as effective carriers of primary oil lubricants to result in reduced wear factors of reciprocating and rotating engine components. The rhodium (and/or rhenium) influence on the combustion process results in a reduction of combustion temperatures to minimize or eliminate the production of oxides of nitrogen during the combustion process.

OBJECTS OF INVENTION

An object of the present invention, accordingly, as expressed in said parent and copending applications, is to take advantage of the above-described discovery in providing a new and improved method of and catalytic cell for improving the completion of combustion characteristics of oxygenated hydrocarbon fuels through catalytic and electrolytic pre-treatment of the fuel.

An additional object of the invention is to provide a novel method of entraining hydroxyl ions within the hydrocarbon fuel (pre-combustion) that have been found materially to contribute to the scavenging or substantial eliminating of the noxious by-products of combustion during and post-combustion; and more generically, to the making available of such hydroxyl ions for the combustion and/or post-combustion states in order to effect such scavenging.

A further object is to provide a novel fuel-modifying catalytic cell that provides for a catalytic response in the fuel supply of gasoline when the element is immersed in the gasoline with an electrolytic response developed by the exposure of the fuel to the dissimilar metals, preferably zinc or other similar negative metal as the anodic element and platinum, rhodium, rhenium, palladium and similar metals as the cathodic element, and the resulting development of metal ions, as before explained.

Still another object, particularly of concern in the present continuation-in-part appliction, is to provide improved efficiency electromotive-catalytic cell structures as well.

An additional object is to provide also or alternatively for extended and/or substituted hydroxyl ion or hydrogen oxide scavenging in the before-stated "post-combustion stages", including, also, by other hydroxyl-ion generating techniques than said cell structures, and to extend the same to other hydrocarbon and noxious by-product effluents in other combustion and industrial stacks and systems, as well.

While electrolytic cells have been used as water correction devices (Butler U.S. Pat. No. 2,469,680, for example), and to a limited extent in hydrocarbon products, such devices have not heretofore been effective for catalytic response in the pre-treatment of gasoline as an engine fuel.

This invention, as described in said parent application, has been designed and constructed to obviate the limitations and failures of earlier catalytic or electrolytic devices and to provide for low cost manufacture, extended service life of up to several years in automotive fuel applications and maximum exposure of the engine fuel to the catalytic influences of the appropriate metals as employed in the fabrication and assembly of the catalytic cell. The invention also may be applied to bulk storage tanks of gasoline and other hydrocarbon fluids with motion imposed on the catalytic cell(s) in order to accomplish cost effective and beneficial results. As a practical solution to the expanding problems associated wiht atmospheric pollutions from combustion emissions, it is important that this invention can be applied to the estimated eighty percent of road vehicles which fail to meet present clean air standards as determined by the use of appropriate and approved evaluation equipment as made us of during intervals of vehicle inspection rather than by prescription of universal application when product usage is not indicated or required.

Other and further objects will be discussed hereinafter, being more particularly delineated in the appended claims.

SUMMARY

In summary, however, from one of its viewpoints, the invention of said parent and copending applications embraces a method of improving the progression and totality of combustion of oxygenated hydrocarbon fuels that leads to the substantial reduction or elimination of noxious emission by-products, that comprises, immersing within the fuel prior to combustion juxtaposed zinc and platinum (and rhodium or rhenium or other noble or platinum-family metal) surfaces; during such flowing, relatively moving the surfaces and fuel to provide for continual contacting therewith, continaully generating electropotentials resulting from the before-mentioned inherent different electrochemical series fractional or few volt potentials stemming from the different position of the different contacting metals in the electrochemical series (Zn: −0.76 v; Pt: 1.118 v; Rh: 0.600 v; Re: 0.300 v; Fe: −0.037 to −0.447 v; Ag: 0.799 to 1.98 v, etc.) This has been found electrolytically and also catalytically to convert oxygen in the fuel to hydroxyl ions and hydrogen oxides which, on combustion with the atmosphere, cause the fuel to propagate ignition evenly through the entire combustion process while effecting a reduction or elimination of noxious emissions including by conversion, absorption and/or scavenging of the elements by the hydroxyl ions that would otherwise form the undesired by-products of incomplete combustion.

The utility of the invention can be measured effectively by equipment as used in the established practice of testing the degree of efficiency of any catalytic converter system and the composition of exhausted products of the combustion of hydrocarbon fuel combustion in any internal combustion engine. With and without catalytic systems in place and in certain cases with the useful purpose of a catalytic converter system reduced to a point where compliance with defined standards, as imposed by the Environmental Protection Agency (EPA) of the federal government and certain states, is impaired and inoperative, the introduction of the catalytic cell of the invention will result in an effective modification of the burning characteristics of the gasoline to a degree where the test measurement will define the exhaust as having substantially zero carbon monoxide (CO) and zero hydrocarbon particulates (HC). A measurable increase in the production of carbon dioxide ($CO_2$) provides confirmation of the modified chemistry of the exhausted elements and in volume of complete compatibility with parameters of EPA requirements.

In particular connection with this application, preferred and best mode hydroxyl ion (and hydrogen oxides) generators, including electromotive force-catalytic cells and other generators are provided for use in pre- and post-combustion states, and more generally, for scavenging noxious combustion products including not only in vehicle exhauses but the exhausts and stacks of industrial and related plants, as well.

DRAWINGS

FIG. 1 illustrates an elevation of a novel construction of the catalytic cell, as provided for in said parent application and developed in said copending application, for practicing the method thereof, being partly broken away to show the internal construction. The internal anodic element of the invention is of a dimension that will result in the continual reciprocating movement of that element in the moving vehicle fuel tank to provide for the induction of the fuel constantly to the multi-metal surfaces of the catalytic cell.

FIG. 4 is a system diagram illustrating the broad principles of the invention applied to industrial exhausts and the like.

DESCRIPTION

Figure 1:
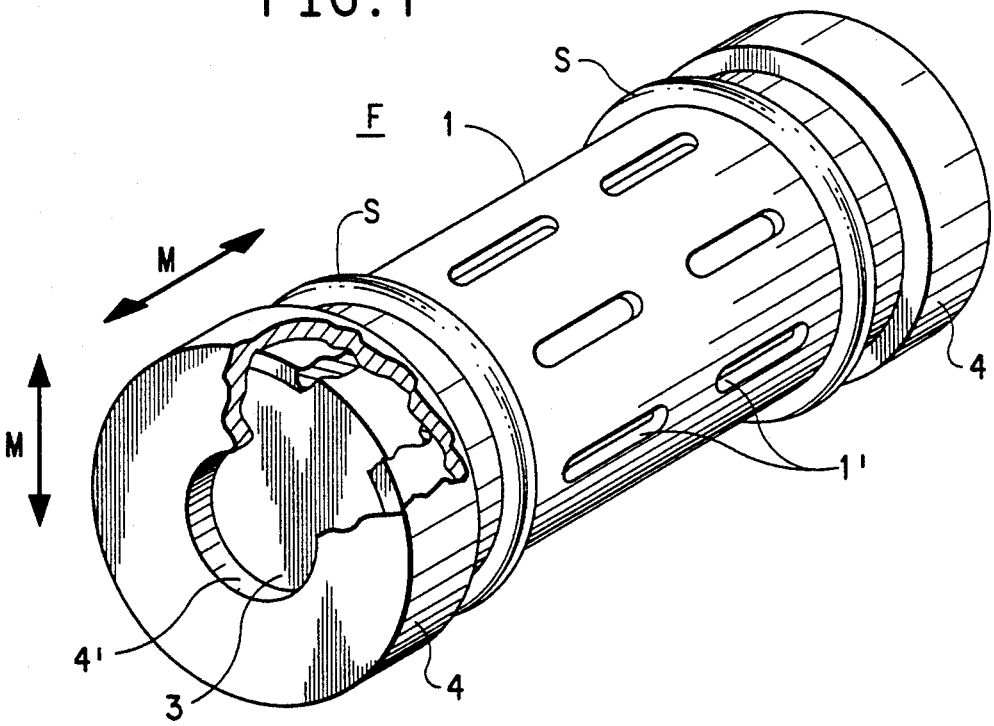

Referring to FIG. 1 of the drawing, a perforated brass or bronze cylindrical tubular housing, plated for catalytic purposes with platinum on its exterior and interior surfaces is shown at 1, the perforations being illustrated as slots 1', preferably circumferentially symmetrically disposed about the cylinder, to permit the entry and exit of fuel F in which the cell is immersed, as when the cell is dropped into the vehicle fuel tank containing, for example, gasoline or diesel fuel, as later discussed, with its usual content of accumulated water and air or oxygen from the filling process. The cathode tube 1 (effectively "platinum" inside and out) has removable end caps 4, also perforated at 4' to permit the flow of the fuel and preferably provided with rhodium or rhenium plating, inside and out.

The cathodic cylindrical tubular housing 1 contains an anodic similarly cylindrical rod member 3 of pure zinc, with the length and cross-sectional dimensions of the anodic rod member slightly less than the inner length of the housing 1 between the end caps 4 and the inner diameter of the housing, respectively, such as to provide for slight clearance and for the free or induced flow of fuel along all surfaces of the catalytic cell. As operated, with the fuel flowing as the vehicle and its tank are in motion and the anode rod 3 continually reciprocatingly moving, engaging and contacting the opposed inner walls of the cathode housing 1 and its end caps 4, juxtaposed and continual intimate contact of the anode rod surfaces and the cathode inner surfaces of the invention is achieved during the entire service life of the device, continually generating electrochemical series electropotentials and surprisingly evenly distributing the hydroxyl ions and hydrogen oxides throughout the fuel. While the preferred form of a (negative) anodic element is as a solid rod of pure zinc, there may be substituted pellets of other shapes as dictated by the convenience of manufacture, assembly and required exposure to the fluid environment within which the metal is to be operative.

Electrically insulating O-rings or bumper washers or a composition suitable to prolonged exposure to hydrocarbon fuels are provided at spaced points at S along the external cylindrical body of the cell 1 to prevent electrical contact of the cell with the fuel container on a constant basis since the long dimension of the cell will be the resting direction. The end caps of the element, shorter than the cylinder 1 and rod 3, are plated either with rhodium or rhenium and are installed permanently to the tubular portion of the cell. The insulation of the element from the surface of the fuel tank, except infrequently, permits the electromotive reaction of the zinc element 3 and the inner platinum surface of the cathodic tube 1 and the inner rhodium surfaces of the end caps 4 as the hydrocarbon fuel flows therebetween during the movement of the vehicle and its fuel tank. In addition, the back-and-forth or reciprocating inside motion (M) of the zinc anode 3 within the cylinder, which is continual during movement of the vehicle, provides a measure of piston-like action that induces and circulates a continuous flow of the fuel into and over the opposed surfaces of the elements, insuring uniform fuel treatment and enabling uniform catalytic reaction. This gives rise to the before-described well-distributed hydroxyl ion and stabilized hydrogen oxide pre-combustion modification of the fuel that has been discovered to adapt it for the novel progressive ignition and substantially complete combustion results previously described, also eliminating noxious exhaust products, including the deleterious precursors of ozone, acid rain and carcinogens, among them carbon monoxide, hydrocarbon particulates, nitrogen oxides, sulphur oxides, ozone, methane, etc.

The metallurgy of the invention thus makes use of noble or platinum-family metals such as platinum, palladium, rhodium and rhenium, all of which have the capacity to act as agents of catalysts on hydrocarbon fuels when energized or ionized by a device with an electrolytic potential—in this case by means of intimate and continual electrolytic and direct contact of anodic and cathodic surfaces inherently self-generating electrochemical series fractional or few volt potential as before noted. The invention, moreover, provides for the containment of the anodic element in a form that assures exposure of the anodic metal to the fluid environment within which it is placed in operation and with maximum exposure of the electrolytic fluid environment to the catalytic influence of the cathodic surfaces (platinum and rhodium and rhenium) and in such form that the reaction is sustained for an extended period with contact existing among portions of the prescribed metal surfaces and the fluid at all times and with a surprisingly uniform distribution of moving hydroxyl ions or radicals throughout the fuel supply. The catalytic cell is a low-cost and cost-beneficial applicance for use in automotive vechiles, boats and other equipment of that nature with substantial benefit to environmental and ecological conditions and with an over-compensating reduction in fuel consumption by such equipment as the product is used.

Successful operation has been obtained in automotive vwehicles when the fuel tanks of such vehicles have been equipped by immersion of one or more of such catalytic cells as the volume of contained fuel would dictate. A typical catalytic cell so used had an overall length of one and one-half inches and a circumference of one-half inch at the tubular portion of the element 1. The multiple slot perforations (eight pairs distributed symmetrically about the cell cylinder) were each one-eighth inch wide and a half inch long. A rod 3 of pure zinc with clearance of +0.0075 inch from the cathode cylinder inner walls was employed for a fuel supply tnk with a capacity of less than twenty gallons, with successful operation in the described manner. When the fuel supply tank has a capacity in excess of twenty gallons, the use of two catalytic fuel cells is prescribed with an additional catalytic cell to be placed in use as the fluid volume is increased by increments of twenty gallons contained within the fuel supply tank. By extrapolation, an adequate decrease or increase in the required size of the element can be defined and fixed, but for general application, as required in the foreign and domestic population of automotive vehicles, it has been determined that a cell of the indicated dimensions is adequate and useful.

The following Table 1 demonstrates the efficacy of the invention. These data were developed by the use of EPA-approved emission evaluation test equipment after the installation and use of either one or two catalytic cells, with installation made after these vehicles, with moderate and extended mileage, had failed to meet acceptable EPA-mandated emission parameters. In such cases, the normal procedure, dictated by EPA and state regulations, would require that operational privileges for an offending vehicle be withheld until replacement had been made of an inoperative catalytic converter system or other repairs. The efficient service life of these and several hundred other vehicles was validated by EPA-type testing annually and the indicated compliance with EPA operational standards for each vehicle.

half-inch diameter dimensions before described, subjected to normal vehicular movements, has been found to generate sufficient hydroxyl and metal ions distributed sufficiently uniformly and continually throughout the fuel to provide the successful degree of noxious by-product elimination in Table 1.

While the invention has been mainly described for the illustrative example of hydrocarbon fuel combustion in internal combustion engines, it is believed that the broad discovery underlying the invention of the scavenging effect of well- or evenly-distributed hydroxyl ions during combustion is more widely applicable in other kinds of hydrocarbon burning or combustion systems, as well, including those where the hydroxyl ions may be made available during and/or post combustion to effect the hydroxyl radical combination, converting, absorbing or scavenging of the elements that would otherwise form the noxious by-products. Electrolytic cell generators of the type described herein, appropriately configured, ELECTROLYTIC & CATALYTIC FUEL CELLS
Performance Data + − Compliance With Emission Standards of EPA

| Test #2441332 | | Test #0386103 | | Test #1314629 | | Test #0518072 |
|---|---|---|---|---|---|---|
| LOC #1086 | | LOC #1127 | | LOC #1491 | | INSP STATION No. 1705 |
| Sep. 19, 1985 | | Jan. 24, 1986 | | May 23, 1985 | | May 22, 1985 - Time - 11:54 AM |
| INSP #8407 | | INSP #7808 | | INSP #12080 | | INSP #9500 |
| TEST TYPE I | | TEST TYPE I | | TEST TYPE I | | TEST TYPE I |
| VEH MAKE | | VEH MAKE | | VEH MAKE | | VEH MAKE - Ford - 83 |
| OLDS M | | CHEV | | FORD | | MILEAGE (000's) - 38 |
| VEH YR 82 | | VEH YR 79 | | VEH YR 82 | | LIC NO. - 320 KFO |
| ODOM 090638 | | ODOM 039059 | | ODOM 077000 | | ENG CYL - 8 |
| LIC PLATE | | LIC PLATE | | LIC PLATE | | FUEL TYPE - GAS |
| 539 HUM | | 941 GEO | | HE74979 | | VEH TYPE - PASS CAR |
| FUEL G | | FUEL G | | FUEL G | | CATALYTIC CONVERTER - PRESENT |
| # CYL 8 | | # CYL 8 | | # CYL 8 | | FILLER RESTRICTOR - PRESENT |
| VEH TYPE A | | VEH TYPE A | | VEH TYPE B | | HC SPEC 220 TEST 0 PASS |
| HC | 14 PPM | HC | 57 PPM | HC | 1 PPM | CO SPEC 1.20 TEST .00 PASS |
| LIMIT | 220 | LIMIT | 400 | LIMIT | 220 | CO2 SPEC 4.0 TEST 9.5 OK |
| CO | 0.00% | CO | 0.03% | CO | 0.00% | RPM SPEC 1200 TEST 1034 OK |
| LIMIT | 1.20 | LIMIT | 4.00 | LIMIT | 1.20 | TEST RESULT - PASS |
| PASS | HC | PASS | HC | PASS | HC | SAFETY REPORT - ALL PASS |
| PASS | CO | PASS | CO | PASS | CO | INSPECTION STICKER NO. |
| VALID | CO2 | VALID | CO2 | VALID | CO@ | 0518072 |
| VALID | RPM | VALID | RPM | VALID | RPM | |
| SAFETY FAIL | | SAFETY FAIL | | SAFETY FAIL | | |
| NONE | | NONE | | NONE | | |
| STICKER NO. | | STICKER NO. | | STICKER NO. | | |
| 2441332 | | 0386103 | | 1314629 | | |

NOTES:
These data are reported as duplicates of official print-outs of computer analyses of these vehicles in compliance with emission standards as defined by the Environmental Protection Agency and the Commonwealth of Massachusetts. The emissions test equipment was of a type approved for that purpose by the Environmental Protection Agency and each test was initiated and completed at an Inspection Test Station as approved by the Commonwealth of Massachusetts. Tests Nos. 2441332, 0386103 and 13 14629 were made after these vehicles had been tested and failed an original emission evaluation. A catalytic fuel cell was placed in the fuel supply tank of each vehicle and each vehicle was operated for fifty miles. A second test was initiated at that point and results are as indicated above. Each vehicle continues to function in compliance with EPA standards. These data are references developed by such acceptable procedures for approximately 500 vehicles.

A determination of the quantity of hydroxyl ions or radicals, necessary or sufficient to cause the effective combining, conversion, absorption and/or scavenging of the fuel elements by the hydroxyl ions or radicals, which elements would otherwise have formed the noxious by-products in normal combustion, may be empirically arrived at for each fuel supply system—first, by observing the uniformity and distribution of the Brownian-movement of the hydroxyl ions or radicals throughout a sample of the fuel and which it has been found should be well-distributed for effective operation; and secondly, by measuring the level of by-product still in the exhaust, and increasing the hydroxyl ion generation to minimize or eliminate the same, as desired. As a guideline, in a twenty gallon gasoline tank for an automobile, a single cylindrical catalytic electromotive or electropotential cell of the one and one-half inch by may be used, for example, with auxilliary fuel supplies to inject hydroxyl ions into other types of combustion processes and stacks, and other techniques including chemical generation of the hydroxyl ions may also be employed.

In connection with the value of hydroxyl radicals as scavengers of gasses that are common as by-products of the combustion process within internal combustion engines, it appears that such operation is of value for that same purpose irrespective of the particular mechanics of the combustion process as, for example, within furnaces, oil burners, power plants, smelters, steel mills, etc., and regardless of the nature of the hydrocarbon fuel employed to produce combustion. The significant consideration is that any combustion process produces gaseous residues as emission products and hydroxyl ions have been found to have a capacity to scavenge or assimilate such products. In this process, emissions from all forms of combustion could be reduced or eliminated either during or after the combustion cycle by the introduction of hydroxyl ions into the ambient atmosphere that supports the combustion process. The simple structure of hydrogen (one electron and one proton) permits separation by an electrolytic or catalytic process to result in the structuring of hydrogen ion (which is in fact the remaining proton) and, in the presence of oxygen, becomes hydroxyl ion or radical. A most important consideration is that scavenging does occur when several by-products of hydrocarbon combustion are exposed to hydroxyl radicals such as is evident in the scavenging of carbon monoxide, nitrogen oxides and other residues that develop from the production of hydroxyl ions within gasoline that has been exposed to the composite influence of the catalytic fuel cell of the present invention.

Figure 2:
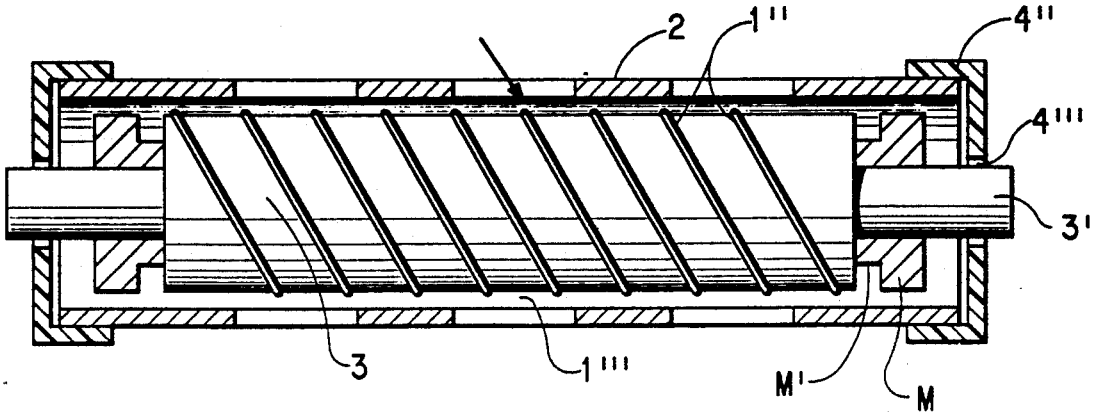
FIGS. 2 and 3 are longitudinal sections of modifications.

It has now been found, as described in said copending application, that significantly improved operation can be achieved if the apertured cathode is constructed not as a slotted platinum-family-surfaced cylinder housing 1—1', but as a conductive helical platinum-family-surfaced winding 1'', FIG. 2, with inherent helical path open areas 1''' (corresponding to the slots 1') that permit direct contact of the inner anode 3 with the fuel. For example, the surfacing of the cathode 1'' may be plated or otherwise deposited rhodium or rhenium. Further to increase the efficacy of the electromotive electrochemical series potential-catalytic action, the cathode 1'' may be wound, preferably tightly, about the surface of zinc anode 3 (which may also be a zinc-iron mixture or alloy), with the assembly 1''-3 again reciprocatingly mounted within an outer slotted cylinder housing or cage 2 having high-dielectrc insulating and mounting end caps 4'' (as of "TEFLON", for example) of larger diameter than the housing or cage 2 and provided with bearing end apertures 4'''. Again, the end-caps mounts 4'' not only retain the anode-cathode cell assembly, but serve to insulate the same from contact with the surface of the fuel tank. The outer slotted cylindrical housing or cage 2 may electively be plated with platinum or palladium (hydrogen-attracting) or an alternative noble metal as dictated by the particular fuel being effectively reformulated by the hydroxyl ion conversion of the invention, exposing, through its slots or openings, all surfaces to the electrolytic fuel.

To further improve the efficacy, oxygen-attracting or increased oxygen-collecting metal inserts, such as ferrous metal (iron) washers M, with a reduced inner flange M' to allow free flow of the fuel electrolyte to contact both sides of the washer, may be freely mounted at the ends of the zinc anode 3, as on the reduced diameter terminal shaft portions 3' thereof, which can be rotatably and reciprocatingly supported in the end cap bearing apertures 4'''.

Figure 3:
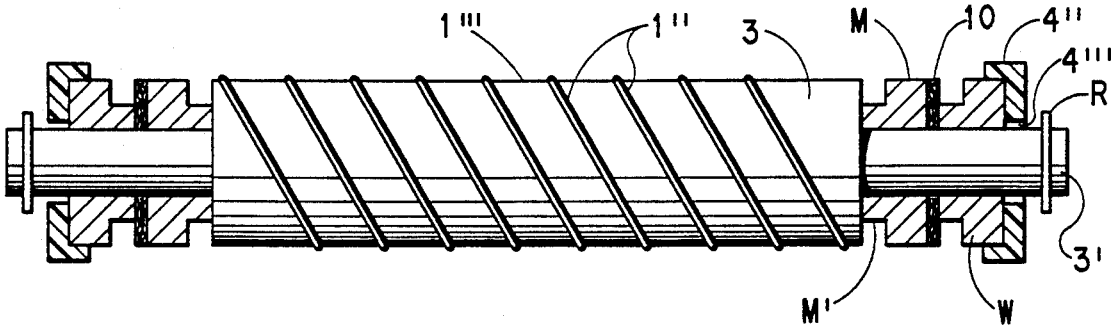

For cost reduction and other reasons, the outer cylindrical cage 2 may be eliminated, if desired, as shown in FIG. 3, wherein the ferrous metal or similar washers M—M' are assembled with insulating fiber washers 10 and, where appropriate, further platinum or hydrogen-attracting and holding palladium or similar flanged washers W, all freely carried by the reduced diameter terminal shaft portions 3' of the zinc anode 3, in turn, mounted within the apertures 4''' of the larger diameter insulator end caps 4''. A keeper ring R may be provided at each end of the terminal or shaft anode portions 3' extending axially beyond the end caps 4''. In this embodiment, the end caps serve as a terminal support or housing for resting the cell on the bottom of the fuel tank, subject to reciprocating along the tank bottom during the before-mentioned vehicle movement.

Where such structures are to be used for diesel type fuels (and in other applications), it has been found useful to magnetize the elements M to provide enveloping supplemental or amplifying fields about the anode-cathode assembly that aid in the process of the invention. For such application, palladium cathode surfaces 1'' have been found particularly useful.

Figure 3A:
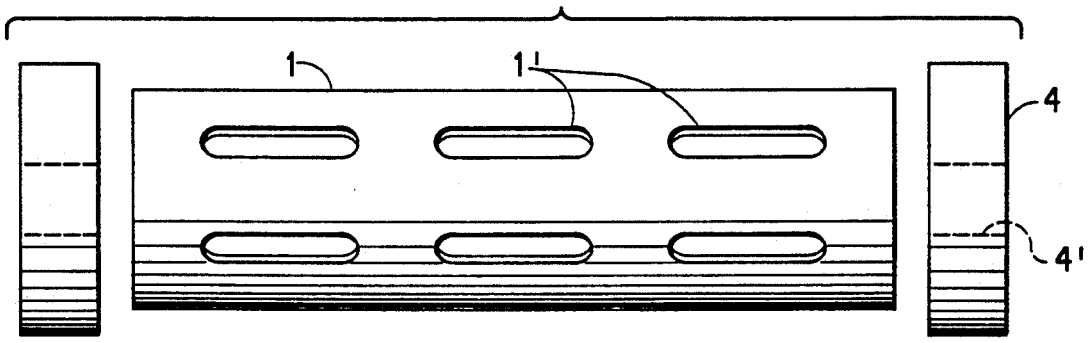
FIGS. 3A, 3B and 3C are side elevations, upon a reduced scale, of an improved cell version of the type shown in FIG. 3, showing, respectively, outer, inner and assembled portions of the modified cell.
Figure 3B:
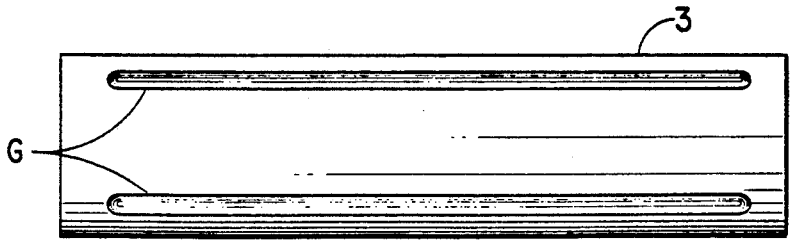
Figure 3C:
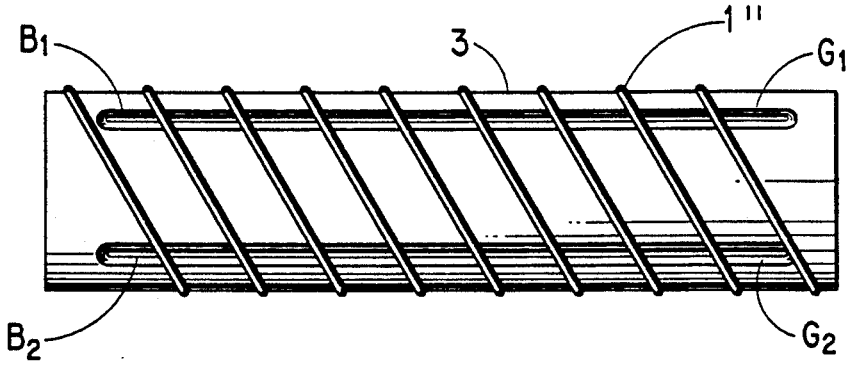

An even more efficacious and universal gasoline-diesel fuel cell construction has now been found to reside in the embodiments of FIGS. 3A, 3B and 3C, illustrating, respectively, outer shell, inner zinc element and assembled components. In FIG. 3A, a mild steel outer shell 1 is shown, as in FIG. 1, providing preferably about 0.060" clearance at the top of the shell from the internal structure, the zinc anode 3 of which, is shown in FIG. 3B, as containing a plurality (preferably three) of equally circumferentially spaced longitudinal grooves G extending almost the complete length thereof. The purpose of the longitudinal grooves G, two of which are shown in each of FIGS. 3B and 3C, is to contain anode-contacting rhodium or rhenium, platinum and iron (steel) surfaces used in the other cell embodiments in a more efficacious and cost effective manner, particularly where the helical noble metal surface winding 1'' is to be employed, as in the embodiments of FIGS. 2 and 3.

Thus, in the modified cell of FIG. 3C, a groove $G'_1$ in the zinc anode 3, contains a platinum-family noble rhodium or rhenium strip (such as a bronze bar plated with the rhodium or rhenium). A groove $G_2$ similarly receives therein a platinum strip (again such as a bronze bar plated with platinum), and a third groove (not shown and on the reverse surface of the anode 3) contains ferrous metal bar as of mild steel—all held within the helical winding 1'', which, in this case, is preferably of noble metal such as a silver-plated bronze wire wrapped securely around the zinc anode. The electrochemical potentials for this zinc-silver anode-cathode assembly had the values earlier presented and have been found to work admirably in field tests of automobiles. In practice, grooves about 3/32" in depth have been found to be satisfactory, with the inserted strips about ⅛" in thickness to provide 1/32" clearance between the same and the wire wrapping. A clearance is left at the ends of the strip-containing grooves of about 0.030", and the assembly of FIG. 3C is inserted in the shell 1 of FIG. 3A, resting on the bottom and with the end caps 4' closing off the structure.

The design of FIGS. 3A-3C is particularly useful for recent changes in fuel chemistry. While there is water in all gasoline, the growing use of oxygenates in fuels has changed the chemistry of gasoline, including MTBE. The metals selected for use in the embodiment of FIGS. 3A-3C, including some higher in the electrochemical potential series, serves the objective to extract one atom of hydrogen from the water present in the fuel to result in the formation of OH as a radical. Palladium is also excellent for that purpose and has been made use of in diesel applications. OH, however, is destructive of some metals and its production must be controlled within the fuel. The design of FIGS. 3A-3C represents a combination of metals which accomplishes reformulation of the fuel without excessive OH.

In all of the embodiments of FIGS. 1, 2, 3 and 3A-3C, as in those of said parent application, however, the electrolytic cell is immersed within an electrolyte. A chemical reaction between the metals of the cell and the electrolyte will produce an electromotive force and this galvanic action produces direct current in a sufficient amount to produce a chemical change in the fuel, accomplishing these changes in the fuel without the benefit of any outside source of electrical energy. It is the inherent electrochemical series potential differences of the different metals of the cell that provides, in effect, a self-generating internal battery of fractional or few volts potential, which operates within the fuel for this purpose and consistent with the environment which is developed therein by the action of hydrogen. When hydrogen is extracted and attracted to a metal of the cell, there is a change in the chemistry of the fuel and in the chemistry of the electrolyte which surrounds the element.

A negative electrical potential and a positive electrical potential are developed by the differences in the series of the metals used in the cells of the invention, such series being the order in which metals combine or destruct by the transfer of metal salts to other metals. In a hydrogen environment, this phenomenon is active. A negative electric potential attracts electrons to form a chemical bonding. A positive electric potential releases electrons which form a bonding in another metal. The use of metals of distinctive valence determines the transfer of electrons from one metal to another to develop an electrical direct current by electrochemical means. The valence associated with the metals selected in the cell determines the capacity of an atom or a group of atoms to combine in specific proportions with other atoms or group of atoms. Each of the metals in the cell serves a definite purpose in this respect and an active cathodic and anodic reaction is developed within the electrolyte without the benefit of any external input of electrical energy.

While, moreover, the invention has been described with reference to the scavenging action effected by the introduction of hydroxyl ions and hydrogen oxides in the fuel prior to combustion, there are some instances where such hydrogen ion introduction can be effected, as previously described in said parent and copending applications, in the "post combustion stages". In particular connection with what was earlier described in said parent and copending applications as making hydroxyl ions available during such post combustion to effect the hydroxyl radical combination, converting, absorbing or scavenging, the principles of the invention may more generically be extended from vehicle hydrocarbon fuel combustion exhaust systems, as above described, also to the exhaust of other types of combustion processes and stacks. As further stated in said parent and copending applications, not only may the described electrolytic cell generators be configured for such more general use, but other techniques including chemical generation of the hydroxyl ions and their injection at appropriate locations may also be employed.

Figure 4:
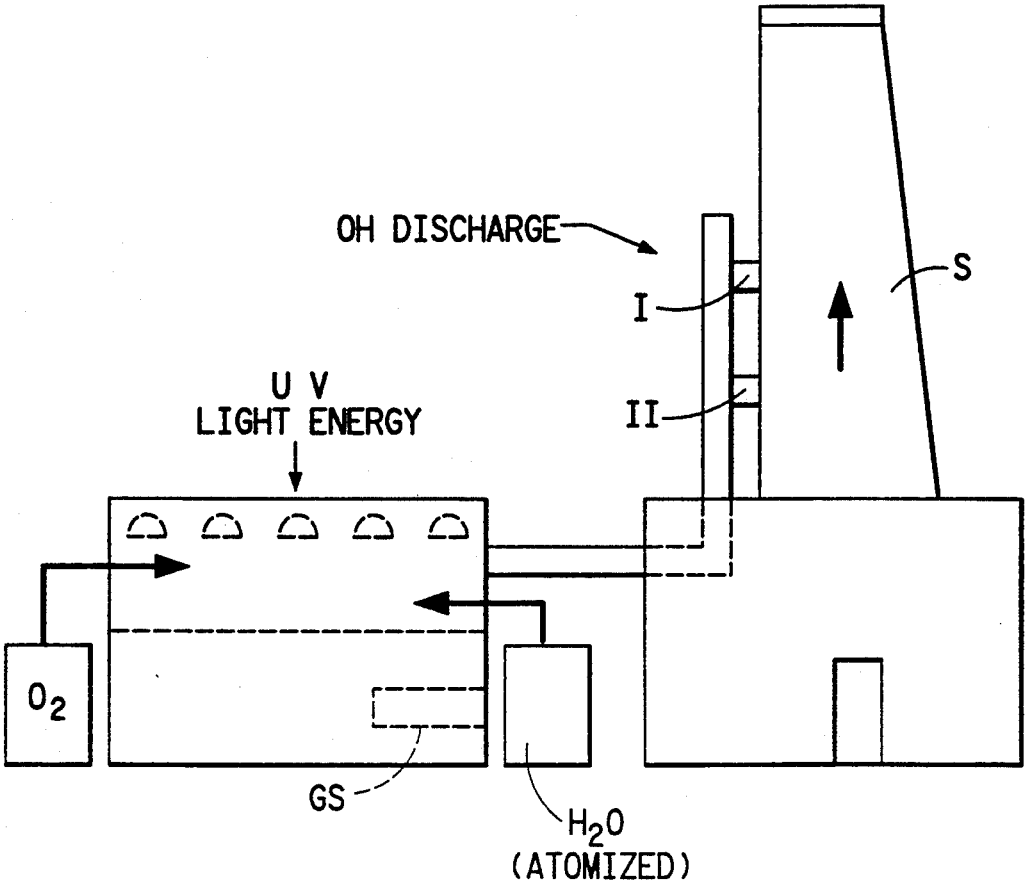

An example of such is shown in FIG. 4, wherein the hydroxyl ions are illustrated as generated by the exposure of oxygen ($O_2$) and atomized water ($H_2O$) to ultraviolet light (UV) and applied or injected at regions I and II of an exhaust stack S from which flue gases of a combustion process are extracted.

The release or injection of the hydroxyl OH ions at a plurality of successive locations I and II into the exhaust or effluent stack stream may be regulated in accordance with the volume and chemistry of the flue gases, as by a flue gas sensor GS monitoring the exhaust and automatically controlling the flow of $O_2$ and $H_2O$ accordingly, to enable the benefit of OH-scavenging in the stack exhausts of $SO_2$, as, for example, before that noxious combustion product (or other by-product) can exit into the ambient atmosphere as a pollutant and as a precursor of deleterious super-acid rain.

As another example, open dump sites and areas of animal husbandry result in $CH_4$ (methane) pollutant as a greenhouse gas. The application of hydroxyl OH ions as a fogged environment at the locus of methan accumulation will abate or eliminate this source of $CH_4$ pollution.

Further modifications will also occur to those skilled in this art such as, for example, in connection with the electromotive-catalytic cells, the use of other negative anodic metals in pellet form, with which pellets of rhenium might be mixed to provide for beneficial operation of the cell when certain gasoline fuel blends might be placed in selective service. Other mofidications might include alteration of the geometric shapes of the cells or of the interdependent components of the catalytic element; particular sizes an shapes as may be dictated by vehicle modifications either for retro-fit or original equipment applications and other variants; other cell-element moving mechanisms than the motion-induced reciprocation of the anode rod within the housing; and other post-combustion and hydroxyl ion generating and injecting techniques and applications may also be used to practice the underlying generic process of the invention, all such being considered to fall within the spirit and scope of the invention as described in the appended claims.

What is claimed is:

1. In combination with a hydrocarbon fuel combustion system in which hydrocarbon fuel containing entrapped oxygen, hydrogen and water is supplied for combustion from a storage vessel containing the fuel, means immersed within the fuel in the vessel for converting oxygen and hydrogen in the fuel to at least one of hydroxyl ions and hydrogen oxides, said means comprising an electrochemical series potential cell having a cathodic element and a juxtaposed anodic element both in contact with the fuel and of different metals in the electrochemical series, electrolytically to operate the cell by inherently self-generated electrochemical series fractional to few volt potentials only.

2. An electrolytic-catalytic cell for hydrocarbon fuel having, in combination, a negative potential anodic element surrounded by a cathodic noble metal surface providing openings exposing the anodic element directly to the fuel.

3. An electrolytic-catalytic cell as claimed in claim 2 wherein the cathodic surface comprises a helical winding element about the anodic element.

4. An electrolytic-catalytic cell as claimed in claim 3 and in which the anodic element comprises zinc.

5. An electrolytic-catalytic cell as claimed in claim 3 and in which the anodic element is of cylindrical form and the helical winding wraps around the anodic cylindrical element.

6. An electrolytic-catalytic cell as claimed in claim 5 and in which the anodic and cathodic elements are movably mounted within an apertured housing carrying one of a platinum-family surface and a steel surface.

7. An electrolytic-catalytic cell as claimed in claim 5 and in which the anodic element is provided separately of the cathodic helical winding element with ferrous metal means.

8. An electrolytic-catalytic cell as claimed in claim 7 and in which the ferrous metal means is carried by reduced diameter terminal extensions of the anodic element.

9. An electrolytic-catalytic cell as claimed in claim 7 and in which the ferrous metal means is carried in a groove in the anodic element.

10. An electrolytic-catalytic cell as claimed in claim 7 and in which the ferrous metal means are magnetized.

11. An electrolytic-catalytic cell as claimed in claim 5 and in which the anodic element is provided with grooves containing one or more of platinum-family and ferrous metal elements therein.

12. An electrolytic-catalytic cell as claimed in claim 11 and in which the helical winding is of silver surface.

13. An electrolytic-catalytic cell as claimed in claim 3 and in which platinum-family metal elements are provided at the ends of the anodic element external of the said helical winding element.

14. An electrolytic-catalytic cell as claimed in claim 2 and in which the anodic element is provided with ends at which insulating mounts are disposed.

15. A method of improving the substantial elimination of noxious emission by-products of combustion of oxygenated hydrocarbons, that comprises, supplying in at least one of pre- and post-combustion regions sufficient hydroxyl ions well distributed throughout such region substantially to scavenge the elements that generate such noxious emissions and thereby substantially eliminate said by-products.

16. A method as claimed in claim 15 and in which said hydroxyl ion supplying is effected by electrolytic-catalytic action of juxtaposed immediately adjacent anodic and cathodic different electrochemical series potential metal electrode surfaces at such region.

17. A method as claimed in claim 15 and in which said hydroxyl ion supplying is effected post-combustion in a flue gas combustion process by injecting hydroxyl ions into the flue gas exhaust or effluent of such combustion process.

18. A method as claimed in claim 17 and in which such hydroxyl ion injecting is effected at a plurality of successive locations in such exhaust or effluent.

19. A method as claimed in claim 17 and in which the injected hydroxyl ions are automatically controlled as needed in response to monitoring the properties of the exhaust of effluent.

20. A method as claimed in claim 17 and in which the hydroxyl ions are generated by reacting ultraviolet light with a mixture of oxygen and water.

* * * * *